United States Patent [19]

Burling

[11] 4,456,142

[45] Jun. 26, 1984

[54] CONTAINER

[75] Inventor: Berkley S. Burling, Warrandyte, Australia

[73] Assignee: Acmil Plastic Products Pty. Ltd., Bentleigh, Australia

[21] Appl. No.: 328,678

[22] Filed: Dec. 8, 1981

[30] Foreign Application Priority Data

Dec. 10, 1980 [AU] Australia ..... PE6860

[51] Int. Cl.[3] ..... B65D 6/10; B65D 6/24

[52] U.S. Cl. ..... 220/4 F; 52/563; 99/452; 99/453; 99/460; 100/265; 165/80 D; 206/508; 206/509; 217/65; 220/1.5; 220/93; 220/445

[58] Field of Search ..... 52/275, 284, 429, 430, 52/563; 62/457; 98/6; 99/452, 453, 458, 467, 460; 165/80 D; 206/508, 509; 217/65, 69; 220/4 F, 426, 445, 1.5, 93; 229/43; 426/106, 109, 418, 114, 512, 582, 513; 100/265

[56] References Cited

U.S. PATENT DOCUMENTS

| | | | |
|---|---|---|---|
| 630,341 | 8/1899 | Garber | 98/6 |
| 695,677 | 3/1902 | Faris | 217/65 |
| 877,700 | 1/1908 | Brockmann | 220/93 |
| 1,054,655 | 2/1913 | Ives | 229/43 |
| 1,294,225 | 2/1919 | Bellingham | 52/563 |
| 3,054,362 | 9/1962 | Seidle | 220/4 F |
| 3,118,559 | 1/1964 | Stricker, Jr. | 220/1.5 |
| 3,586,201 | 6/1971 | Ebert | 206/508 |
| 3,643,993 | 2/1972 | Asadurian | 220/1.5 |
| 3,724,711 | 4/1973 | George et al. | 220/426 |
| 3,968,879 | 7/1976 | Lucas, Sr. et al. | 206/509 |
| 4,011,706 | 3/1977 | Dupree | 217/65 |
| 4,147,001 | 4/1979 | Oliver | 52/284 |

FOREIGN PATENT DOCUMENTS

| | | | |
|---|---|---|---|
| 1359743 | 3/1964 | France | 220/4 F |

*Primary Examiner*—George E. Lowrance
*Assistant Examiner*—Jimmy G. Foster
*Attorney, Agent, or Firm*—Larson and Taylor

[57] ABSTRACT

A container (10, 55) suitable for the packaging of a block of cheese for maturing, the container comprising an assembly of separately formed wall members (11, 51, 55). The wall members (11, 51, 55) forming the sides of the container each include a planar wall section (12, 52, 56) and means (17, 53, 58) associated with an outer side thereof to define passages (15, 54, 59) adjacent said planar wall section and open to the atmosphere for circulation of air therethrough for cooling purposes. Corner forming means (22, 22', 61) integral with the wall members, and detachably connected to mating corner forming means of the adjacent side wall members to hold the side wall members in an assembled condition. In one example the sidewall members have a single planar wall section (52) on the outer side of which webs (53) are provided to define passages in the form of channels (54). In another example the side wall members comprise separate inner and outer wall sections (12 and 13) between which interlocking rib arrangements (14) are provided to hold the sections together and to also define the passages (15). In a still further example the side wall members comprise inner and outer wall sections (56 and 57) between which integral webs (58) are provided to provide a unitary structure, and to define the passages (59).

2 Claims, 9 Drawing Figures

11
12
13
14
15
16
17
18
19
20
21
22
23
24
25
26
27
28
29
30
31
32
33
34
40
41
50

CONTAINER

TECHNICAL FIELD

This invention relates to a container, and more particularly a container in the form of a box commonly referred to as a cheese box. Although the container of the present invention has been developed primarily for use as a cheese box, and particularly for relatively large blocks of cheese, it is capable of application to the packaging of other products, such as, for the storage and/or transportation of butter, fish, wine and chemicals.

BACKGROUND ART

It is practice to package large blocks of cheese in wooden boxes or carboard boxes for maturation and/or transport between the point of cheese manufacture and other centres where the relatively large blocks of cheese will be subsequently cut into smaller size blocks for packaging and sale. Development work in relation to plants for cheese production has resulted in the production of a large sized cheese block of in the order of 640 lbs. After maturing these large blocks are firstly cut into 16×40 lb blocks, which are either then used for processed cheese or further cut into smaller sizes and packaged for retail sale. The production of such large blocks has been found to be much cheaper and eliminates pilphering, common with smaller blocks. However, the production of such large sized blocks has presented special problems in relation to the packaging thereof for maturing, transport and/or storage purposes. The major problem results from the significantly greater weight of the cheese blocks particularly when stored in containers one on top of the other six high in storage centres for maturing purposes and clearly cardboard boxes do not have sufficient strength. Although wooden boxes will normally withstand the weight forces applied during storage, and can be re-used, there is also some waste of material and labour as for a cardboard box. Wood panels also exhibit slow cooling characteristics which are disadvantageous in situations where the product packaged therein has to be cooled, such as is required during the processing of cheese.

Furthermore, users of wooden boxes have found that such boxes have unhygienic aspects, particularly when the components are re-used, and when roughly handled the components have a habit of delaminating and splintering, whilst knot areas have to be repaired. There is also the possibility of contamination of the product, such as cheese, due to absorption of wood resin. Furthermore the tare weight of the box overall is high due to the associated ironmongery and metal strapping materials. The wooden panels of such known boxes have to be thoroughly cleaned and dewaxed before resue due to the fact that whey dripping from the cheese in the first few days of maturation becomes impregnated in the wood and the wax. The wooden panels also have to be recoated with a new protective skin of wax. The requirement to provide wax coatings is also of a disadvantage insofar as it is a derivative of the petroleum industry, and thus its cost is increasing. Disposal of residual wax cleaned from box components is also a problem in order to comply with environmental authority requirements. Furthermore, after new wax skins are applied to box panels and they are subsequently stacked for transportation and/or storage, it is necessary in order to separate the panels from the stacks for workmen to use hammers and levers to separate the panels due to the tendency of the wax coatings to cause adjacent panels to adhere together particularly in climatic conditions where high temperatures are encountered. Additional costs are incurred due to the energy costs associated with the melting off of residual wax and washing, and the necessity to melt the new wax prior to application to the panels during refurbishing.

Known boxes also incorporate a considerable number of steel components all of which have to be washed, de-waxed and then re-waxed, whilst careful attention must be given to inspecting for rust formation and to apply special treatment when rust is located. Bent or damaged steel components also have to be repaired or replaced, and all these additional components also have to be transported and/or stored.

All of the above problems associated with known cheese box constructions, add considerably to the cost of the box. Its handling, including assembly and disassembly, and cleaning, which costs are reflected in both material costs and labour costs.

The problems associated with wooden containers, particularly wooden cheese boxes, has led to the desire to find an alternative, and one such alternative is the use of boxes formed from plastics components, the advantages of some of which are relatively good stability when exposed to high temperatures, the more convenient fabricating techniques associated therewith such as injection molding and extrusion. Plastic components can also be autoclaved or washed efficiently, and in many cases are totally resistant to chemical attack, including attack by acids or alkalines. The components also do not corrode or require wax treatment, and normally retain their original colour whilst being to a large extent more impact resistant than wood. Plastic also lends itself to the design of components which can be readily assembled and disassembled with a minimum of components (in the order of 50% less components than for conventional wooden boxes), whilst are generally lighter than wood and provide a non-variable box weight. Plastic components can also be designed to achieve more efficient strength and cooling characteristics than is possible with wooden components. However, with large sized blocks of the type under consideration, the walls of the boxes must be sufficiently strong to withstand the load forces applied during transportation, and more particularly during storage where the boxes are stacked up to six high for maturing purposes. In order to overcome this problem the wall of the box may be formed of sufficient thickness to withstand such load forces. However, the more thickness required, apart from being wasteful of material and therefore costly, particularly when plastics materials are utilised, also produces a further disadvantage in that for maturing purposes it is required that air circulate around the boxes as close as possible to the inner wall surfaces of the box, and therefore the cheese.

It is therefore an object of the present invention to provide a wall member for a container, and in particular a wall member for a cheese box, which, when combined with other wall members to form a container, will overcome the above problems and at the same time provide for relatively easy assembly of a container therefrom, as well as disassembly of the container whereby it may be reused.

DISCLOSURE OF THE INVENTION

The invention envisages a wall member for a container including a planar wall section and means associated with an outer side thereof to define at least part of at least one passage adjacent said planar wall section and along which air can circulate, corner forming means provided on opposite side edges of said wall member whereby, when associated with another wall member to form a corner of a container, the corner forming means of said wall member can be united with mating corner forming means of associated wall member to detachably connect said wall members together at said corner.

Preferably said planar wall section is a first wall section which is associated with a second wall section, said means associated with said first wall section serving, or forming part of means serving, to space said sections apart in parallel relationship and to define, with said second wall section, the, or each, said passage.

Preferably the first and second wall sections are separately formed wall sections carrying means by which they may be joined in said spaced apart parallel relationship.

Alternatively the first and second wall sections may be formed in said spaced apart parallel relationship as a unitary body such as by an injection moulding or extrusion operation in which case the corner forming means can conveniently consist of male and female interlocking formations.

Preferably a plurality of passages are formed between said wall sections, and said first wall section provides the inner surface of a container to be formed and said second wall section provides the outer surface of the container and may have apertures therethrough communicating with said passages formed by the combination of said wall sections.

According to the invention there is also provided a container suitable for the packaging of a block of cheese for maturing, the container comprising an assembly of separately formed wall members, wherein the wall members forming the sides of the container each include a planar wall section and means associated with an outer side thereof to define at least part of at least one passage adjacent said planar wall section and open to the atmosphere for circulation of air therethrough for cooling purposes, and corner forming means integral with the wall members, the corner forming means of each side wall member being detachably connected to mating corner forming means of the adjacent side wall members to hold the side wall members in an assembled condition.

Preferably the corner forming means of each side wall member are adapted to interlock with the mating corner forming means of the adjacent side wall members.

Preferably said wall section is an inner wall section and is associated with an outer wall section, said means associated with said inner wall section serving, or forming part of means serving, to space said sections apart in parallel relationship and to define, with said outer wall section, the, or each, said passage.

The inner and outer wall sections may be separate components provided with means holding the wall sections together, in which case the side edges of one wall section can be conveniently formed with corner formations adapted to interlock with mating corner formations on the side edges of wall sections of the adjacent side wall members.

Alternatively, the inner and outer wall sections may be formed integral with one another as a unitary structure, such as by an injection moulding or extrusion operation, in which case the side edges of one wall member can be conveniently formed with male formations adapted to interlock with mating female formations on the side edges of the adjacent wall members.

The invention also envisages a container formed from four wall members of the type defined above and having upper and lower wall forming members adapted to close the top and bottom of the container.

Preferably the passages defined by the combination of said first and second wall panels open through the top and bottom edges of said wall members and said upper and lower wall forming members have apertures therethrough aligned with at least some of said passages, whilst a plurality of upstanding pillars are formed on the outer surface of the upper and lower wall forming members to space said containers apart when in a stacked relationship and to allow circulation of air therebetween.

BRIEF DESCRIPTION OF THE DRAWINGS

Several preferred embodiments of the invention will now be described with reference to the accompanying drawings in which.

BEST MODE FOR CARRYING OUT THE INVENTION

Figure 1:
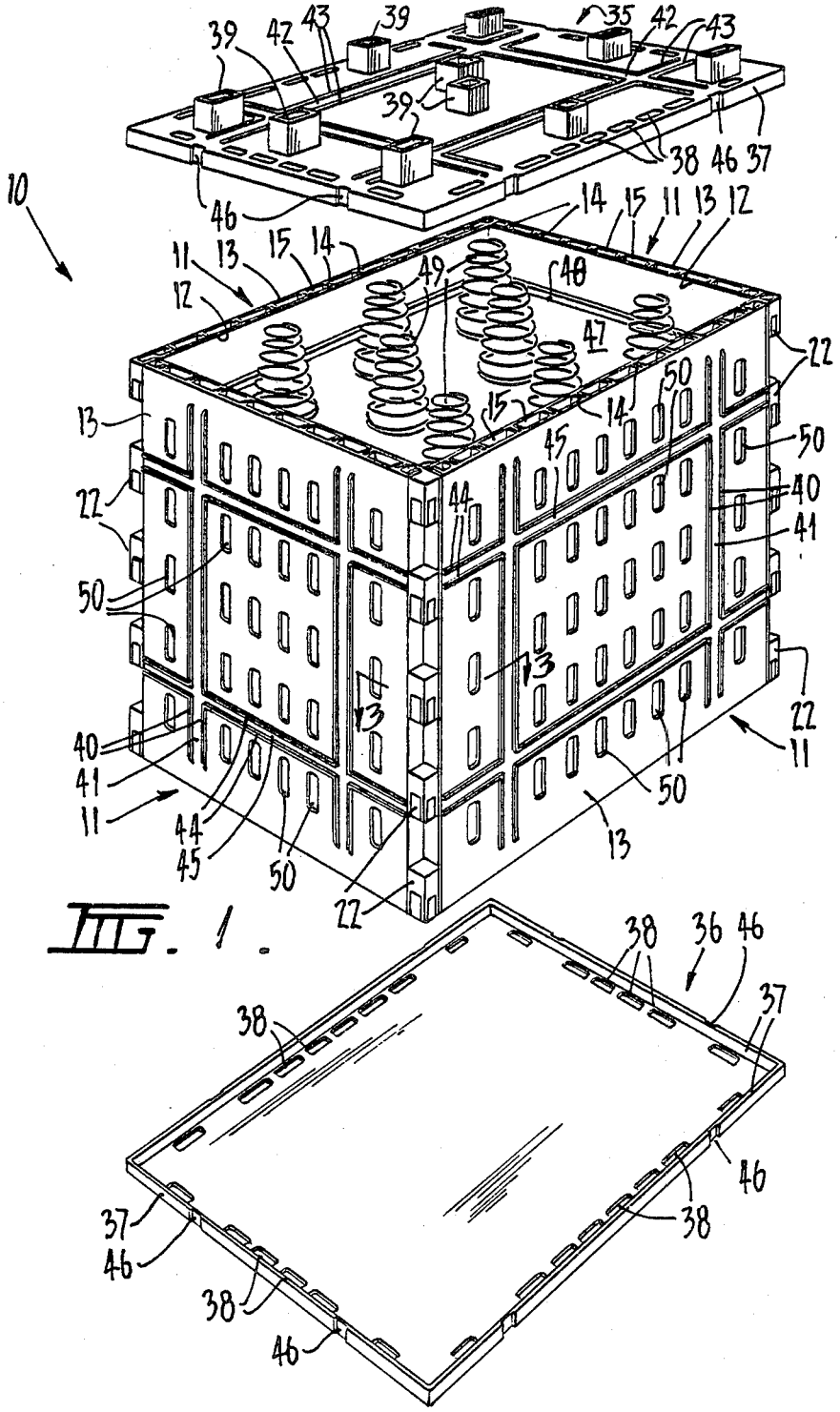
FIG. 1 is a perspective view of a first preferred embodiment of a container according to the present invention, particularly as applied in the form of a cheese box, with the upper and lower wall forming members shown separated from the remainder of the box.

With reference to FIG. 1 of the drawings, there is shown a container, generally indicated as 10, and comprising four side wall members 11 in accordance with the present invention. Each wall member 11 comprises an imperforate inner wall panel 12 and an apertured outer wall panel 13. The inner and outer wall panels 12 and 13 are united together in parallel spaced apart relationship by interlocking rib arrangements 14 spaced apart along the length of, and extending vertically of, the wall members. The wall panels 12 and 13 and the rib arrangements 14 define vertically extending passages 15 between the panels and within the wall members, and opening through the top and bottom thereof as shown.

Referring to FIGS. 2 to 6, the rib arrangements 14 comprise a pair of spaced apart ribs 16 formed integrally with the outer wall panel 13 and extending inwardly of the wall member and between which are received, in relatively tight fitting engagement, a single rib 17 formed integrally with the inner wall panel and extending vertically of the wall member. The height of the ribs 16 and 17 set the distance by which the wall panels are spaced apart when united to form the wall member. The wall member structure produced, comprising the inner and outer vertical wall panels 12 and 13 and the vertically extending rib arrangements 14 provides considerable strength to withstand the vertically applied loads experienced in practice, and referred to previously. A minimum amount of material is used, whilst the passages 15 allow for circulation of air within the wall member and closely adjacent the inner surface of the inner panel 12 of the wall member.

In order to securely hold the inner and outer panels 12 and 13 of each wall member 11 in combination, means are provided on the spaced apart ribs 16 forming part of the outer wall panel 13 which cooperate with means carried by the mating single ribs 17 on the inner wall panel 12.

In this respect, and as shown in FIGS. 2 to 3, and 5 and 6, the single ribs 17 of the interlocking rib arrangements 14, and carried by the inner wall panels 12, have a plurality of enlarged protrusions 32 formed along the free edge of the rib and which form one part of the locking arrangement. As shown, the protrusions taper downwardly to effectively form protrusions of wedge-shaped configuration.

The opposed inwardly facing surfaces of the pairs of ribs 16 on the outer wall panel have a plurality of opposed pairs of slots 33 formed therein at the same spacing as the protrusions 32 on the respective mating rib 17 to provide a passage between the ribs 16 slightly greater than the width of the protrusions and positioned such that with the inner and outer wall panels longitudinally offset from each other the protrusions can enter the respective passages provided by the slots 33, whereafter, upon relative longitudinal movement between the wall panels to bring them into direct alignment with each other from the offset position, the protrusions 32 will move into similarly shaped recesses 34 at the bases of the pairs of ribs 16 thus holding the two wall panels together against separation. It will be appreciated that, in order to separate the panels, they need only be slid longitudinally relative to each other so that the protrusions 32 align with the respective passages provided by the slots 33, whereafter the panels can be moved apart from each other.

Figure 2:
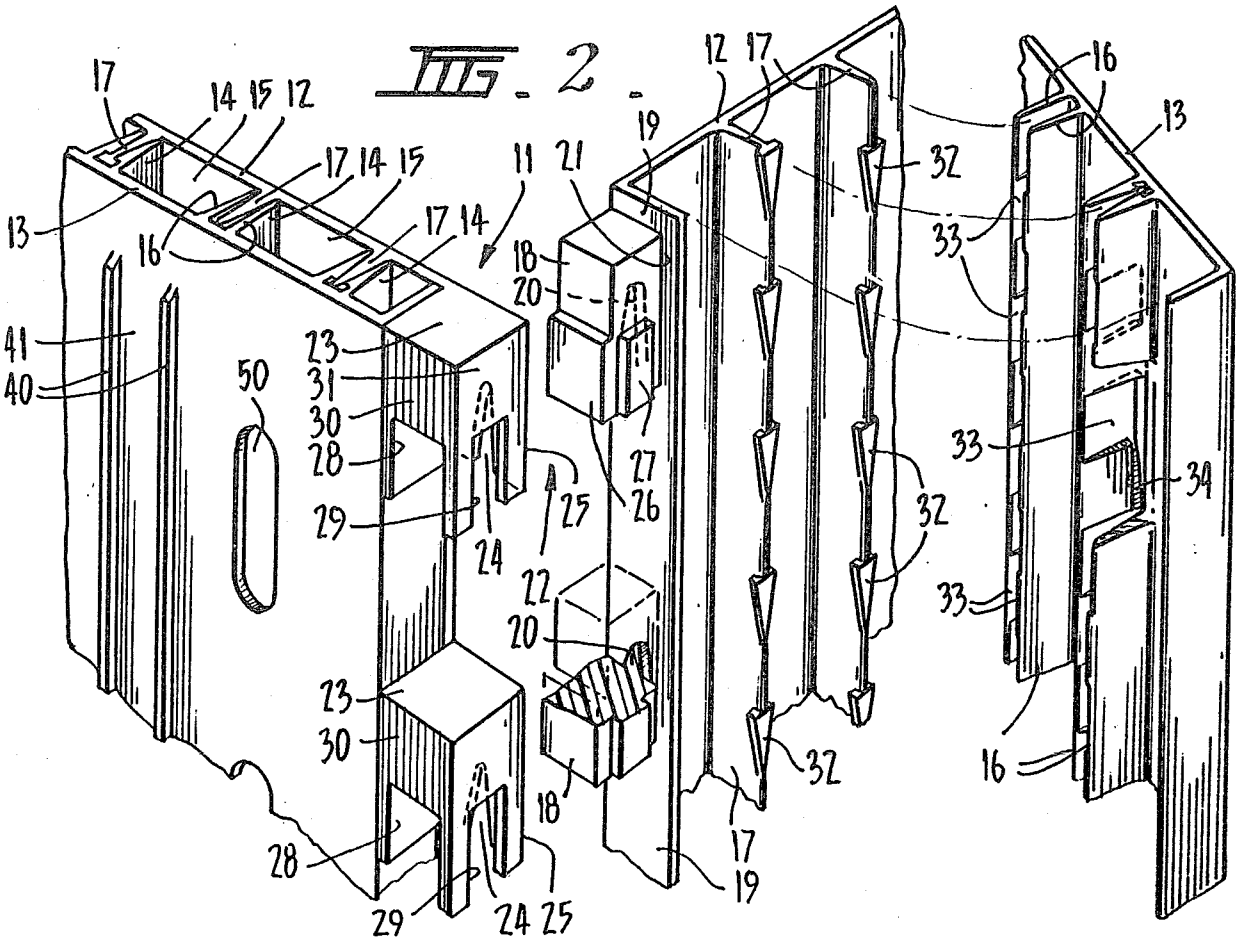
FIG. 2 is a perspective view of an upper corner of the box of FIG. 1 showing the side wall arrangement at the corner in the detached condition.
Figure 4:
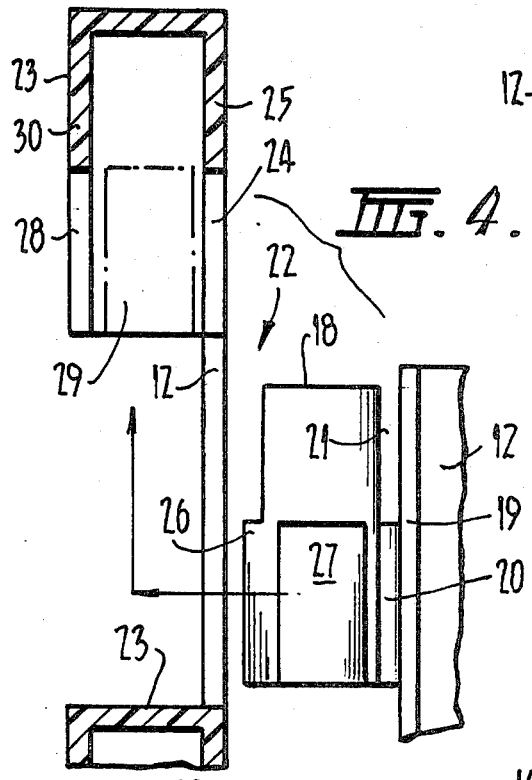
FIG. 4 is a cross-sectional view taken along line 4—4 of FIG. 3 at the corner thereof but in the detached condition.
Figure 5:
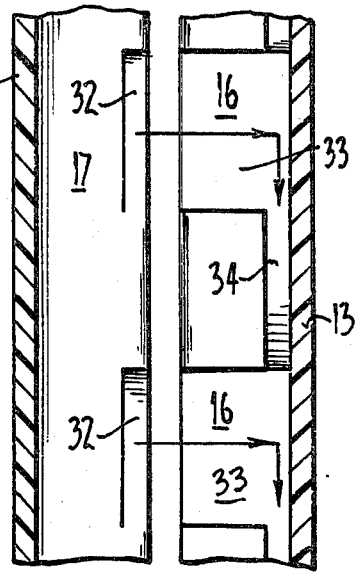
FIG. 5 is a cross-sectional view taken along line 5—5 of FIG. 3 but in the detached condition to show the preliminary step is securing together the inner and outer panels forming the respective side wall members of the embodiment of FIGS. 1 to 4.
Figure 3:
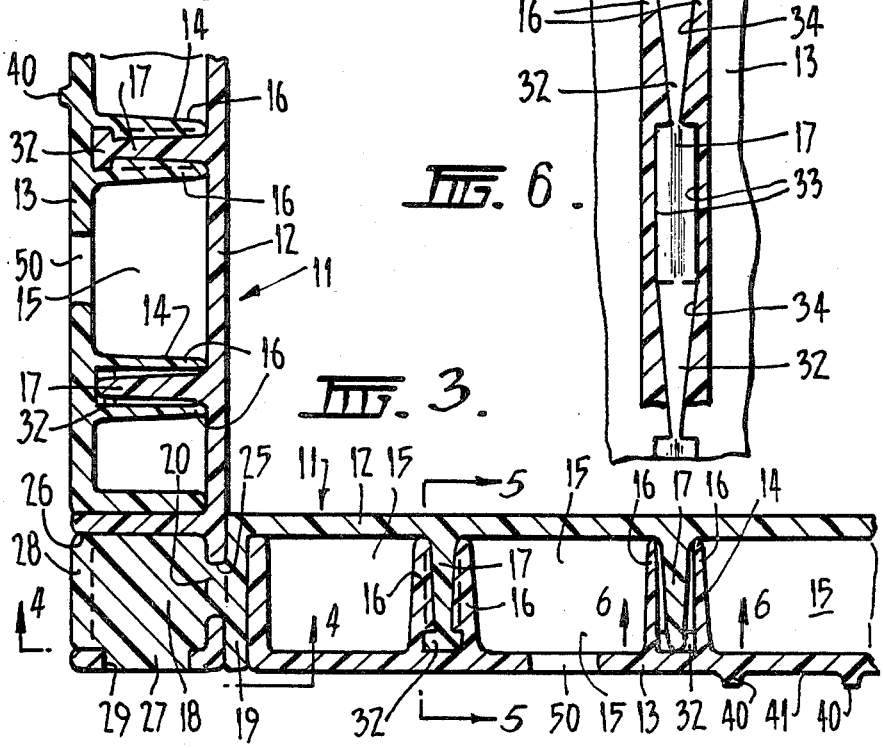
FIG. 3 is a cross-sectional view taken along line 3—3 of FIG. 1.
Figure 6:
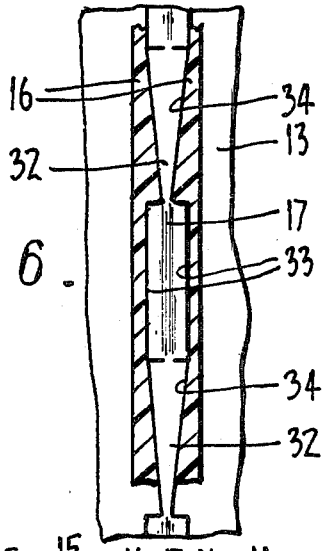
FIG. 6 is a cross-sectional view taken along line 6—6 of FIG. 3.

With reference to FIGS. 1 to 4 of the drawings, in order to detachably unite a pair of adjacent wall members 11 together to form a corner of the container a plurality of vertically spaced apart edge connecting assemblies 22 are provided. With particular reference to FIG. 2 of the drawings, each connecting assembly 22 comprises a male formation 18 of substantially square cross-section and connected to edge flanges 19 of the inner wall panel 12 of the side edges of two of the wall members, forming one pair of opposite sides of the box, via upwardly converging wedge shaped bridging portions 20 and such as to define a gap 21 between the respective male formation 18 and the edge flange 19.

Each connecting assembly 22 is completed by a female formation 23 provided on the opposite side edge of the other two wall members, forming the other part of opposite sides of the box, and integral with the edge of inner panel 12 of those wall members. Each female formation is in the form of a hollow box-like structure closed at its top end as shown, and open at its lower end. During assembly the edges adjacent wall members are positioned such that the male formations 18 are received beneath and aligned with their respective female formations 23 such that subsequent relative movement between the edges of the wall members causes the male formations to slide into, and be received within, its respective female formation, the wedge-shaped bridging portion 20 being accommodated within a matching wedge-shaped cut-out 24 in the wall 25 of the female formation which is received within the gap 21. In order to assist in locating the male formations within their respective female formations, and in order to impart a degree of rigidity to the respective connecting assemblies 22, the male formations are provided with rectangular enlargements 26 and 27 on the lower portions thereof and which are received within matching rectangular cut-outs 28 and 29 respectively through the lower portions of the respective mating walls 30 and 31 of the female formations as shown.

With reference to FIG. 1 of the drawings, the outer wall panel 13 of each wall member is provided with an array of apertures 50 therethrough which communicate with at least some of the passages 15 within the wall member to allow for further circulation of air therethrough. In some applications of the invention the apertures 50 may be omitted.

FIG. 1 shows a cheese box formed from four side wall members 11 united together in the manner discussed previously, and in order to complete the cheese box an upper closure member or lid 35 is provided together with an identical lower or bottom closure member 36. Each closure member has a peripheral rim 37 adapted to be received over the edges of the side wall members 11 and partially onto the adjacent outer sides thereof. An arrangement of apertures 38 is provided around the peripheries of the upper and lower closure members 35 and 36, and when the closure members are placed in position the apertures 38 align with at least some of the passages 15 in the side wall members 11 to allow circulating air to enter the passages. The outer surfaces of both the upper and lower closure members 35 and 36 have a plurality of upstanding pillars 39 formed thereon. The pillars 39 are of hollow configuration to save material. The pillars 39 serve to space the tops and bottoms of the boxes apart when in a stacked relationship to allow circulating air therebetween and into and out of the apertures 38 and the passages 15. The upper and lower closure members 35 and 36 are identical and therefore interchangeable. The arrangement of pillars 39 is such that the pillars on the upper closure member and the pillars on the lower closure member of a container stacked thereon will interlock with each other to prevent, or at least limit, relative movement between the boxes in the stack, whilst linearly extending spaces are provided through the interlocked arrangement of pillars to allow access for the tynes of forklift trucks or like lifting equipment.

Referring again to FIG. 1 of the drawings, the outer surface of each outer panel 13 of the side wall members is provided with two pairs of small vertically extending ribs 40 which define relatively shallow channels 41 for strapping for the box, and which align with channels 42 defined by similar ribs 43 on the outer surfaces of the upper and lower closure members 35 and 36.

The outer surface of the panels 13 are also provided with small horizontally extending ribs 44 defining shallow channels 45 for the receipt of strapping in horizontal planes around the box. At the points where the strapping passes over the upper and lower corners of the box at the rims 37 for the closure members, small indentations 46 are formed to receive the strapping, and, at both these locations, and also possibly at the equivalent locations on the vertical corners of the box, clips (not shown) may be positioned to distribute the load at these locations and to prevent damage to the corners during tightening of the strapping.

Finally, in the case of the preferred embodiment of FIGS. 1 to 6, and particularly as shown in FIG. 1, and which takes the form of a cheese box, a follower plate 47, with an upstanding peripheral rim 48, is provided which fits snugly into the interior of the box on top of a cheese block therein, and in order to exert pressure on the cheese block a plurality of coil spring members 49 may be provided, one end of each of which may surround and be located by a respective pin member (not shown) formed on the upper surface of the follower plate. With such an arrangement, when the upper closure member 35 is placed in position the springs 49 are compressed between the upper closure member 35 and the follower plate 47 and the resulting spring force exerts the required pressure on the cheese block via the follower plate 47 such as to progressively move the follower plate downwardly to maintain pressure on the cheese block as the cheese block shrinks during subsequent maturation.

Figure 7:
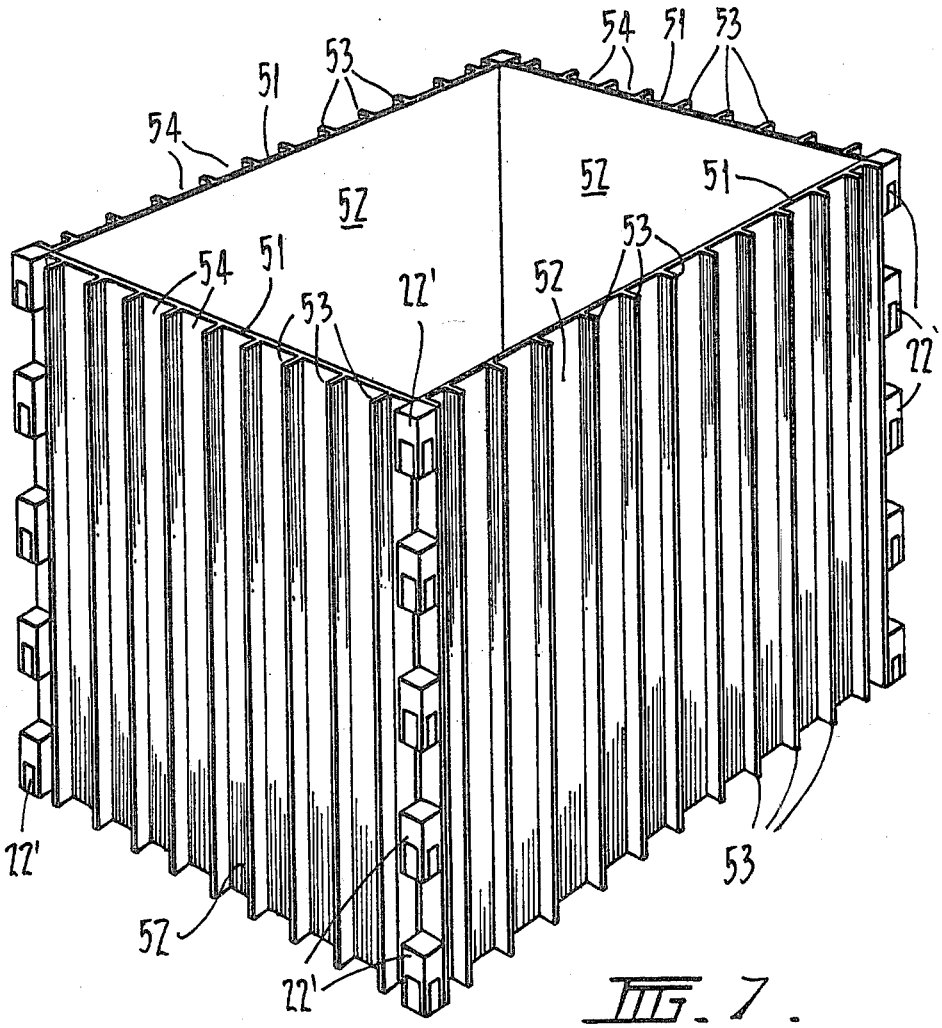
FIG. 7 is a perspective view of a second preferred embodiment of a container according to the present invention, and once again particularly as applied in the form of a cheese box, but with the upper and lower wall forming members removed.

FIG. 7 of the drawings shows a simpler embodiment of the invention, which in some instances may be applicable as a cheese box. In this embodiment each wall member 51 is in the form of a single wall panel similar to the inner wall panel 12 of the embodiment of FIGS. 1 to 6, and which merely consists of a planar imperforate wall section 52 with a plurality of vertically extending ribs or webs 53 which serve to strengthen the wall panel while serving to define parts of vertically extending passages or channels 54.

The edges of the wall members 51 at the corners of the box are united by connecting assemblies 22' identical to the connecting assemblies 22 of the previous embodiment, and the box is completed by upper and lower closure members (not shown) identical with the members 35 and 36 of the previous embodiment, and including arrangements of apertures around their peripheries identical with the apertures 38 of the previous embodiment such as to align with some of the passages or channels 54 between the ribs or webs 53. The upper and lower closure members may also incorporate arrangements of pillars, similar to the pillars 39 of the previous embodiment, together with arrangements of small ribs defining shallow channels, such as 43 and 42 in the previous embodiment, for locating strapping for the box. An arrangement of follower plate and coil springs, such as 47 and 48 in the previous embodiment, may also be incorporated within the box, for the purposes previously discussed. It will be appreciated that when two such boxes are placed side by side the channels in the adjacent wall member combine to form a single passage through which air can circulate.

Figure 8:
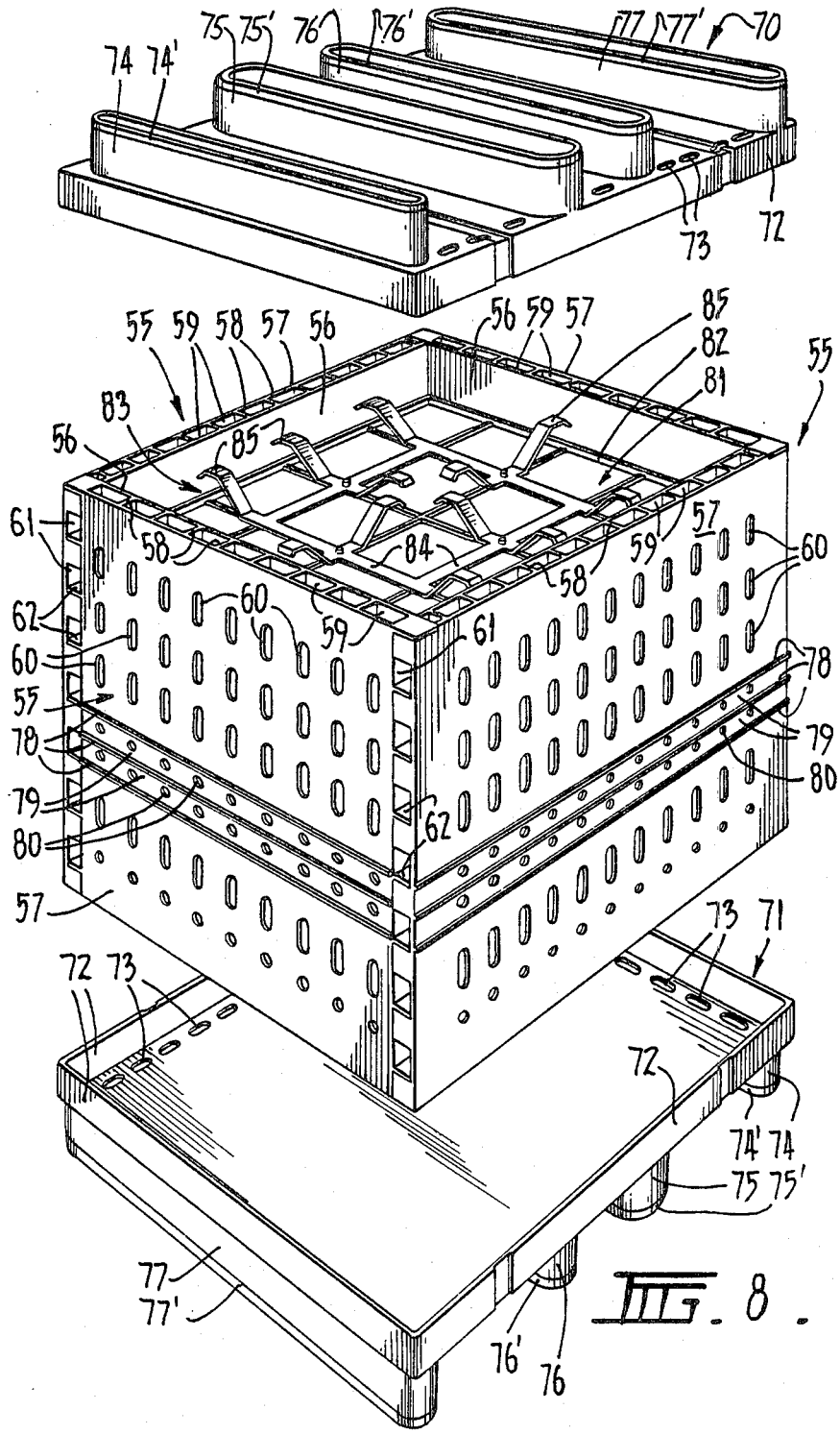
FIG. 8 is a perspective view of a third preferred embodiment of a container according to the present invention, and as again applied in the form of a cheese box, and with the upper and lower wall forming members shown separated from the remainder of the box.
Figure 9:
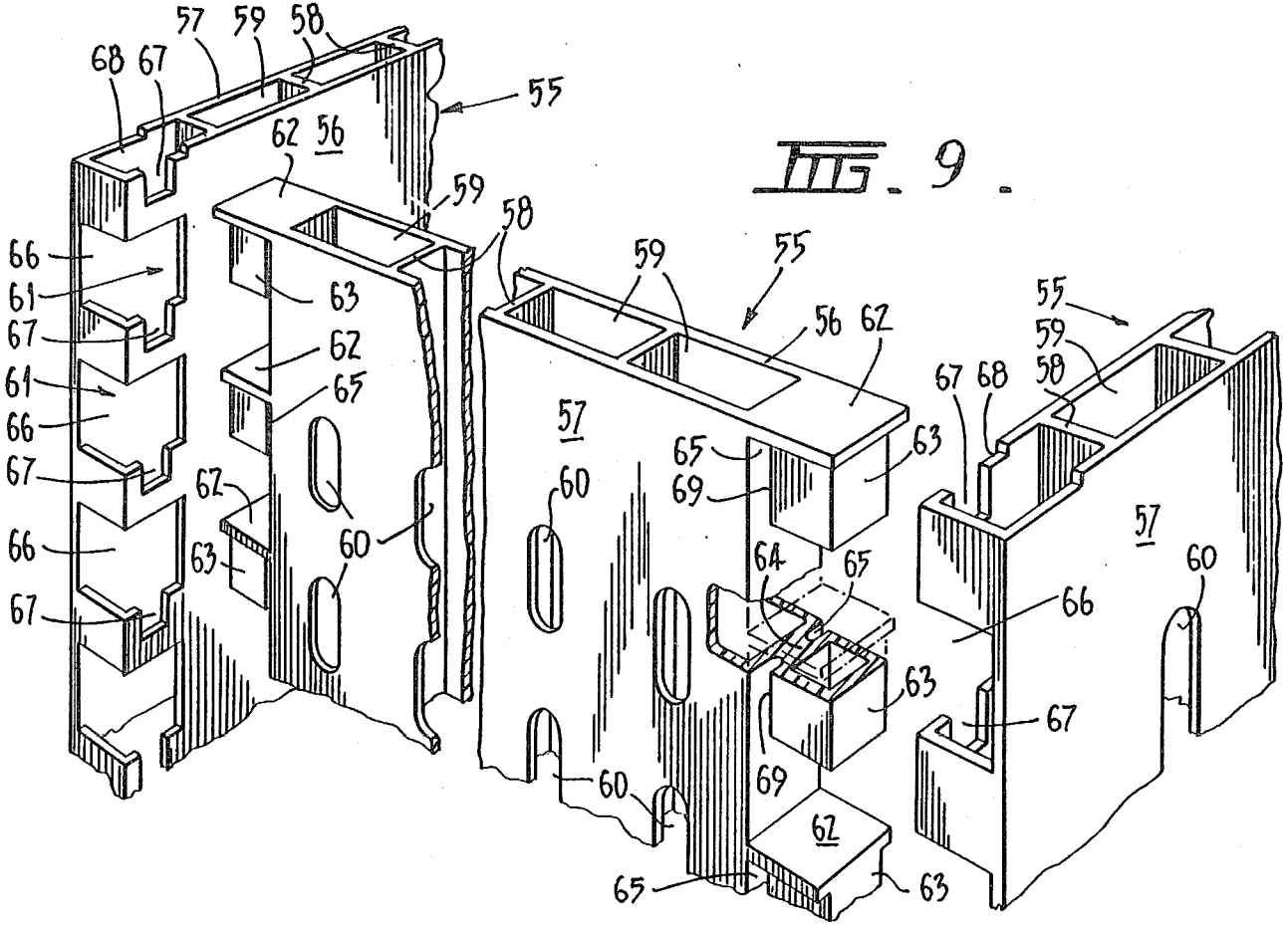
FIG. 9 is an exploded view of an upper section of the side wall members of the box of FIG. 8 showing the corners of the members detached.

FIGS. 8 and 9 of the drawings show a third embodiment of the invention, and once again as applied to a cheese box.

In this third embodiment of the invention, instead of the side wall members being composed of separately formed inner and outer wall panels which are united together in spaced apart relationship by interconnecting rib arrangements, as in the embodiment of FIGS. 1 to 6, the side wall members 55 of this embodiment are formed as unitary bodies, such as by injection moulding or extrusion processes, where equipment of sufficient size is available.

Each wall member 55 consists of an inner imperforate wall section 56 and an outer wall section 57 spaced apart from the inner wall section by a plurality of vertically extending webs 58 which define, with the inner and outer wall sections, a plurality of vertically extending passages 59 through which cooling air can circulate. As shown the outer wall section 57 incorporates apertures 60 therethrough communicating with some of the passages 59, although in some applications the apertures 60 may be omitted.

With referenece to FIGS. 8 and 9, and in particular FIG. 9, in order to detachably unite a pair of adjacent wall members 55 to form a corner of the box, a plurality of connecting assemblies 61 are provided along the adjacent edges of the wall members. In this embodiment the edges of two of the wall members 55 which form opposite sides of the box have a series of ledges 62 formed integrally with, and extending away from, the edges thereof, and from which downwardly extending hollow male formations 63 of generally rectangular cross-section are provided, and which in turn are spaced from the edge of the wall member but connected thereto by a bridging portion 64 adjacent the associated ledge 62, such as to define a lower gap 69 between the male formation and the edge of the wall member as well as a pair of slots 65 on either side of the male formation. The remaining pair of opposed wall members 55 of the box have cut-outs 66 formed in the inner wall section adjacent the edge of the wall member, and also extending around into the edge wall itself as shown. Each cut-out 66 in the region of the lower edge of the section in the inner wall section has an additional cut-out 67 of a width corresponding to the width of the bridging portion 64 for the male formation 63 such that when the male formations on the edge of the adjacent wall member are aligned with the cut-outs 66 they can be inserted therein, whereafter relative movement between the edges at the corners of the box will cause the male formation 63 to engage within the adjacent edge portions of the associated wall member and below the respective cut-outs 66. As shown a cut-out 68 shaped in accordance with only the lowermost portion of the other cut-out 66 is provided at the top edge of the respective wall member 55 such that, when the uppermost mating male formation 63 is received therein, the top edges of the wall members 55 will be flush with each other.

FIG. 8 of the drawings shows a cheese box formed from four side wall members 55 united together at their edges in the manner described above. In order to complete the cheese box an upper closure member or lid 70 is provided together with an identical lower or bottom closure member 71. Each closure member has a peripheral rim 72 adapted to be received over the edges of the side wall members 55 and partially on to the adjacent outer sides thereof. An arrangement of apertures 73 is provided around the peripheries of the closure members, and when the closure members are placed in position the apertures 73 align with at least some of the passages 59 in the side wall members 55 to allow circulating air to enter and leave the passages.

The outer surfaces of both the upper and lower closure members 70 and 71 have an arrangement of hollow elongate pillars 74, 75, 76 and 77 formed thereon.

The arrangement of pillars for the lower closure member 71 transversely of the box is the reverse of the arrangement for the upper closure member, and their widths are such that the pillar 74 on the upper closure member will be received within the pillar 77 of the closure member of a similar box placed thereon in a stack of boxes; the pillar 77 will receive the pillar 74, the pillar 75 will receive the pillar 76; and the pillar 76 will be received within the pillar 75, such as to space the tops and bottoms of the boxes apart by a distance substantially equal to the height of the pillars when in a stacked relationship to allow circulating air therebetween and into and out of the apertures 73 and the passages 59. It will be noted that the upper and lower closure members are effectively identical and therefore interchangeable. The spacing between the pillar 74 and 75, and 76 and 77, is such as to allow access for the tynes of forklift trucks or like lifting equipment. As, in use, the upper edges and the upper internal surfaces of the hollow pillars 74 to 77 are subject to wear, replaceable inserts 74', 75', 76' and 77' may be insertable into the interior of the upper portions of the pillars and over the upper edges thereof, and such inserts when worn may be replaced to avoid the necessity to replace the entire closure members when the pillar surfaces become worn. The bottom walls within the outermost pillars 74 and 77 adjacent the opposite edges of the closure members (as shown for the lower closure member in FIG. 8) incorporate apertures equivalent to the apertures 73 to complete the arrangement of apertures around the peripheries of the respective closure members.

Furthermore, as shown in FIG. 8, the side wall members 55 are provided with an arrangement of three parallel ribs 78, which provide for strengthening of the wall members against bulging or bowing outwardly under pressure internally of the cheese box, and such as would be encountered when a cheese block is placed under compression within the box. The centrally disposed web of the arrangement extends through the wall member to the inner wall section thereof to form webs (not shown) within the wall member and transversely of the passages 59. The webs so formed within the wall member have apertures therethrough not only to allow for continuity of the passages 59 within the wall member, but may also be produced as a result of the manufacturing procedure, such as resulting from the retraction of dye components during the moulding procedure. Additional apertures 80 are provided in the area 79 between the ribs 78 which also not only allow for communication with the passages 59, but may also result from the manufacturing procedure, such as the retraction of certain dye components during the moulding procedure.

In addition, in this embodiment of the invention as applied to a cheese box, a follower plate 81, with an upstanding peripheral rim 82, is provided, which fits snugly into the interior of the box on top of a cheese block therein. In order to exert pressure on the cheese blocks, for the purpose discussed previously, a spider-like member 83 is provided and consisting of a lattice-like grid 84 carrying an arrangement of upwardly inclined and thereafter horizontally extending members 85. The members 85 are adapted to flex when the upper closure member 70 is placed in position such as to exert the required pressure on the cheese block via the follower plate 81. The spider-like member 83 may also be manufactured from plastics material, thus avoiding the necessity to utilise steel coil springs as in the embodiment of FIGS. 1 to 6.

In the above embodiments all components of the cheese box are formed from a plastics material, with the exception of the steel coil springs in the embodiment of FIGS. 1 to 6, and possibly the clips for the corner portions around which the strapping passes in that embodiment, and which may also be formed from steel.

I claim:

1. A cheese-box including a plurality of lightweight sidewall members moulded from thermoplastic material, joined to each other along each vertical edge thereof by integral corner forming means which can be united with corresponding integral corner forming means on an adjoining sidewall member to form a tubular assembly with top and bottom openings; upper and lower end pieces mounted on said assembly to close said top and bottom openings respectively, a follower plate located within said tubular assembly and extending generally in a plane parallel with said upper and lower end pieces; resilient means disposed between said upper end piece and said follower plate and arranged to urge said follower plate to exert pressure on material packaged in said container; each of said sidewall members including a thin imperforate planar section forming one of the interior surfaces of the container and having integral generally vertically directed stiffening ribs extending along the outside thereof; a thin integral outer skin provided on said stiffening ribs defining a series of generally vertically directed flow passages between said thin imperforate planar section and said outer skin; a plurality of access openings provided in said outer skin arranged to allow outside cooling air to enter each of said flow passages; outlet openings provided in said end pieces, said outlet openings being arranged to allow air to flow through said flow passageways and to exit through said outlet openings; said lower end pieces each including a plurality of pillars which are adapted to space apart cheese boxes stacked one atop the other; said upper end pieces including locating means which are adapted to locate the pillars of another cheese box stacked thereon; the cheese box being constructed in such a manner that the sidewall members, upper and lower end pieces, resilient means and follower plate may be readily disassembled without use of tools into individual components after use, in order to allow individual cleaning thereof.

2. A cheese-box as claimed in claim 1 wherein said sidewall members include along the verticial edges thereof, integral interlockable male and female formations which are arranged to allow the edges of adjoining sidewall members to be held together, and said plurality of pillars are arranged to allow access for the tines of forklift trucks.

* * * * *